US009982920B2

(12) United States Patent
Feng et al.

(10) Patent No.: US 9,982,920 B2
(45) Date of Patent: May 29, 2018

(54) OPERATION OF A CASCADE AIR CONDITIONING SYSTEM WITH TWO-PHASE LOOP

(71) Applicant: Carrier Corporation, Farmington, CT (US)

(72) Inventors: Yinshan Feng, South Windsor, CT (US); Jinliang Wang, Ellington, CT (US); Futao Zhao, Farmington, CT (US); Parmesh Verma, South Windsor, CT (US); Thomas D. Radcliff, Vernon, CT (US)

(73) Assignee: CARRIER CORPORATION, Farmington, CT (US)

( * ) Notice: Subject to any disclaimer, the term of this patent is extended or adjusted under 35 U.S.C. 154(b) by 2 days.

(21) Appl. No.: 15/029,824

(22) PCT Filed: Aug. 14, 2014

(86) PCT No.: PCT/US2014/051029

§ 371 (c)(1),
(2) Date: Apr. 15, 2016

(87) PCT Pub. No.: WO2015/057297

PCT Pub. Date: Apr. 23, 2015

(65) Prior Publication Data

US 2016/0258657 A1 Sep. 8, 2016

Related U.S. Application Data

(60) Provisional application No. 61/892,200, filed on Oct. 17, 2013.

(51) Int. Cl.
*F25B 1/00* (2006.01)
*F25B 19/00* (2006.01)
(Continued)

(52) U.S. Cl.
CPC ..... *F25B 7/00* (2013.01); *F25B 9/008* (2013.01); *F25B 23/006* (2013.01);
(Continued)

(58) Field of Classification Search
CPC ..... F25B 9/008; F25B 23/006; F25B 25/005; F25B 7/00; F25B 41/00; F25B 2500/26; F25B 2500/27
(Continued)

(56) References Cited

U.S. PATENT DOCUMENTS 3,142,013 A * 7/1964 McGrath ..... H02H 7/0816 318/471
2011/0185754 A1* 8/2011 Yamashita ..... F24F 3/06 62/132
(Continued)

FOREIGN PATENT DOCUMENTS

CN 1358975 A 7/2002
CN 102105750 A 6/2011
(Continued)

OTHER PUBLICATIONS

Notification of Transmittalof the International Search Report and the Written Opinion of the International Searching Authority, or the Declaration; Application No. PCT/US2014/051029; dated Nov. 21, 2014; 10 pages.
(Continued)

*Primary Examiner* — Frantz Jules
*Assistant Examiner* — Joseph Trpisovsky
(74) *Attorney, Agent, or Firm* — Cantor Colburn LLP

(57) ABSTRACT

A method of operating a heat transfer system includes starting operation of a first heat transfer fluid vapor/compression circulation loop including a fluid pumping mechanism, a heat exchanger for rejecting thermal energy from a first heat transfer fluid, and a heat absorption side of an
(Continued)

internal heat exchanger. A first conduit in a closed fluid circulation loop circulates the first heat transfer fluid therethrough. Operation of a second two-phase heat transfer fluid circulation loop is started after starting operation of the first heat transfer fluid circulation loop. The second heat transfer fluid circulation loop transfers heat to the first heat transfer fluid circulation loop through the internal heat exchanger and includes a heat rejection side of the internal heat exchanger, a liquid pump, and a heat exchanger evaporator. A second conduit in a closed fluid circulation loop circulates a second heat transfer fluid therethrough.

14 Claims, 3 Drawing Sheets

(51) Int. Cl.

| | |
|---|---|
| ***F25B 7/00*** | (2006.01) |
| ***F25B 9/00*** | (2006.01) |
| ***F25B 23/00*** | (2006.01) |
| ***F25B 25/00*** | (2006.01) |
| ***F25B 41/00*** | (2006.01) |

(52) U.S. Cl.
CPC ..... *F25B 25/005* (2013.01); *F25B 41/00* (2013.01); *F25B 2500/26* (2013.01); *F25B 2500/27* (2013.01)

(58) Field of Classification Search
USPC ..... 62/115, 157, 158, 231, 175, 335
See application file for complete search history.

(56) References Cited

U.S. PATENT DOCUMENTS

| | | | | |
|---|---|---|---|---|
| 2012/0227429 | A1* | 9/2012 | Louvar | F25B 23/006 62/196.1 |
| 2012/0324930 | A1* | 12/2012 | Borror | F25B 23/006 62/150 |
| 2013/0036736 | A1* | 2/2013 | Hart | G05D 7/0617 60/645 |

FOREIGN PATENT DOCUMENTS

| | | | |
|---|---|---|---|
| CN | 103090593 | A | 5/2013 |
| EP | 2341295 | A1 | 7/2011 |
| JP | 2004190917 | A | 7/2004 |
| WO | 2013049344 | A2 | 4/2013 |

OTHER PUBLICATIONS

Chinese Office Action Issued in CN Application No. 201480068701.7, dated Jan. 17, 2018, 8 pages.

* cited by examiner

OPERATION OF A CASCADE AIR CONDITIONING SYSTEM WITH TWO-PHASE LOOP

FEDERAL RESEARCH STATEMENT

This invention was made with government support under contract number DE-EE0003955 awarded by the Department of Energy. The government has certain rights in the invention.

BACKGROUND OF THE INVENTION

The present disclosure relates to refrigeration systems. More specifically, the present disclosure relates to refrigeration systems with multiple heat transfer fluid circulation loops.

Refrigerant systems are known in the HVAC&R (heating, ventilation, air conditioning and refrigeration) art, and operate to compress and circulate a heat transfer fluid throughout a closed-loop heat transfer fluid circuit connecting a plurality of components, to transfer heat away from a secondary fluid to be delivered to a climate-controlled space. In a basic refrigerant system, heat transfer fluid is compressed in a compressor from a lower to a higher pressure and delivered to a downstream heat rejection heat exchanger, commonly referred to as a condenser for applications where the fluid is sub-critical and the heat rejection heat exchanger also serves to condense heat transfer fluid from a gas state to a liquid state. From the heat rejection heat exchanger, where heat is typically transferred from the heat transfer fluid to ambient environment, high-pressure heat transfer fluid flows to an expansion device where it is expanded to a lower pressure and temperature and then is routed to an evaporator, where heat transfer fluid cools a secondary heat transfer fluid to be delivered to the conditioned environment. From the evaporator, heat transfer fluid is returned to the compressor. One common example of refrigerant systems is an air conditioning system, which operates to condition (cool and often dehumidify) air to be delivered into a climate-controlled zone or space. Other examples may include refrigeration systems for various applications requiring refrigerated environments.

However, many proposed systems having two-phase $CO_2$ as a secondary heat transfer fluid require the $CO_2$ to be maintained in a supercritical fluid state, which can add to equipment and operating complexity and cost. Further, conventional operation, especially startup, of such a system can result in operational inefficiency and pump cavitation in the secondary heat transfer loop.

BRIEF DESCRIPTION OF THE INVENTION

In one embodiment, a method of operating a heat transfer system includes starting operation of a first heat transfer fluid vapor/compression circulation loop including a fluid pumping mechanism, a heat exchanger for rejecting thermal energy from a first heat transfer fluid, and a heat absorption side of an internal heat exchanger. A first conduit in a closed fluid circulation loop circulates the first heat transfer fluid therethrough. Operation of a second two-phase heat transfer fluid circulation loop is started after starting operation of the first heat transfer fluid circulation loop. The second heat transfer fluid circulation loop transfers heat to the first heat transfer fluid circulation loop through the internal heat exchanger and includes a heat rejection side of the internal heat exchanger, a liquid pump, and a heat exchanger evaporator. A second conduit in a closed fluid circulation loop circulates a second heat transfer fluid therethrough.

In another embodiment, a heat transfer system includes a first two-phase heat transfer fluid vapor/compression circulation loop including a compressor, a heat exchanger condenser, an expansion device, and a heat absorption side of a heat exchanger evaporator/condenser. A first conduit in a closed fluid circulation loop circulates a first heat transfer fluid therethrough. A second two-phase heat transfer fluid circulation loop that transfers heat to the first heat transfer fluid circulation loop through the heat exchanger evaporator/condenser and includes a heat rejection side of the heat exchanger evaporator/condenser, a liquid pump disposed vertically lower than the heat exchanger evaporator/condenser, and a heat exchanger evaporator. A second conduit in a closed fluid circulation loop circulates a second heat transfer fluid therethrough.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Figure 1:
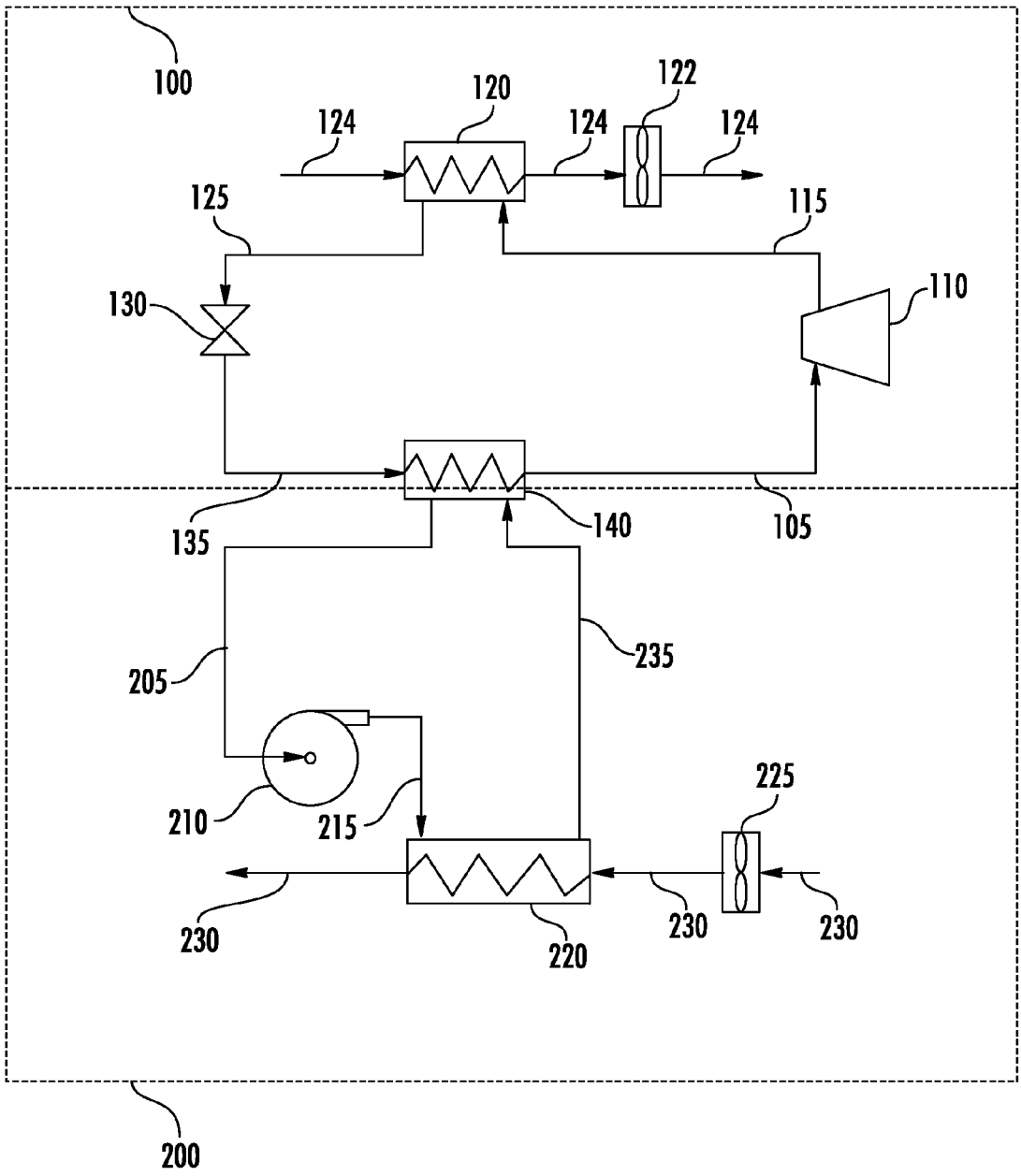
FIG. 1 is a block schematic diagram depicting an embodiment of a heat transfer system having first and second heat transfer fluid circulation loops.

An exemplary heat transfer system with first and second heat transfer fluid circulation loop is shown in block diagram form in FIG. 1. As shown in FIG. 1, a compressor 110 or other pumping device in first fluid circulation loop 100 pressurizes a first heat transfer fluid in its gaseous state, which both heats the fluid and provides pressure to circulate it throughout the system. The hot pressurized gaseous heat transfer fluid exiting from the compressor 110 flows through conduit 115 to heat exchanger condenser 120, which functions as a heat exchanger to transfer heat from the heat transfer fluid to the surrounding environment, such as to air blown by fan 122 through conduit 124 across the heat exchanger condenser 120. The hot heat transfer fluid condenses in the condenser 120 to a pressurized moderate temperature liquid. The liquid heat transfer fluid exiting from the condenser 120 flows through conduit 125 to expansion device 130, where the pressure is reduced. The reduced pressure liquid heat transfer fluid exiting the expansion device 130 flows through conduit 135 to the heat absorption side of heat exchanger evaporator/condenser 140, which functions as a heat exchanger to absorb heat from a second heat transfer fluid in secondary fluid circulation loop 200, and vaporize the first heat transfer fluid to produce heat transfer fluid in its gas state to feed the compressor 110 through conduit 105, thus completing the first fluid circulation loop.

A second heat transfer fluid in second fluid circulation loop 200 transfers heat from the heat rejection side of heat exchanger evaporator/condenser 140 to the first heat transfer fluid on the heat absorption side of the heat exchanger 140, and the second heat transfer fluid vapor is condensed in the process to form second heat transfer fluid in its liquid state. The liquid second heat transfer fluid exits the heat exchanger evaporator/condenser 140 and flows through conduit 205 as a feed stream for liquid pump 210. The liquid second heat transfer fluid exits pump 210 at a higher pressure than the pump inlet pressure and flows through conduit 215 to heat exchanger evaporator 220, where heat is transferred to air blown by fan 225 through conduit 230. Liquid second heat transfer fluid vaporizes in heat exchanger evaporator 220, and gaseous second heat transfer fluid exits the heat exchanger evaporator 220 and flows through conduit 235 to the heat rejection side of heat exchanger evaporator/condenser 140, where it condenses and transfers heat to the first heat transfer fluid in the primary fluid circulation loop 100, thus completing the second fluid circulation loop 200.

In an additional exemplary embodiment, the second fluid circulation loop 200 may include multiple heat exchanger evaporators (and accompanying fans) disposed in parallel in the fluid circulation loop. This may be accomplished by including a header (not shown) in conduit 215 to distribute the second heat transfer fluid output from pump 210 in parallel to a plurality of conduits, each leading to a different heat exchanger evaporator (not shown). The output of each heat exchanger evaporator would feed into another header (not shown), which would feed into conduit 235. Such a system with multiple parallel heat exchanger evaporators can provide heat transfer from a number of locations throughout an indoor environment without requiring a separate outdoor fluid distribution loop for each indoor unit, which cannot be readily achieved using indoor loops based on conventional 2-phase variable refrigerant flow systems that require an expansion device for each evaporator. A similar configuration can optionally be employed in the first fluid circulation loop 100 to include multiple heat exchanger condensers (and accompanying fans and expansion devices) disposed in parallel in the fluid circulation loop, with a header (not shown) in conduit 115 distributing the first heat transfer fluid in parallel to a plurality of conduits each leading to a different heat exchanger condenser and expansion device (not shown), and a header (not shown) in conduit 135 to recombine the parallel fluid flow paths. When multiple heat exchanger condensers are used, the number of heat exchanger condensers and expansion devices would generally be fewer than the number of heat exchanger evaporators.

The first heat transfer fluid circulation loop utilizes heat transfer fluids that are not restricted in terms of flammability and/or toxicity, and this loop is a substantially outdoor loop. The second heat transfer fluid circulation loop utilizes heat transfer fluids that meet certain flammability and toxicity requirements, and this loop is substantially an indoor loop. By substantially outdoor, it is understood that a majority if not the entire loop is outdoors, but that portions of the substantially outdoor first loop may be indoors and that portions of the substantially indoor second loop may be outdoors. In an exemplary embodiment, any indoor portion of the outdoor loop is isolated in a sealed fashion from other protected portions of the indoors so that any leak of the first heat transfer fluid will not escape to protected portions of the indoor structure. In another exemplary embodiment, all of the substantially outdoor loop and components thereof is located outdoors. By at least partially indoor, it is understood that at least a portion of the loop and components thereof is indoors, although some components such as the liquid pump 210 and/or the heat exchanger evaporator condenser 140 may be located outdoors. The at least partially indoor loop can be used to transfer heat from an indoor location that is remote from exterior walls of a building and has more stringent requirements for flammability and toxicity of the heat transfer fluid. The substantially outdoor loop can be used to transfer heat from the indoor loop to the outside environment, and can utilize a heat transfer fluid chosen to provide the outdoor loop with thermodynamic that work efficiently while meeting targets for global warming potential and ozone depleting potential. The placement of portions of the substantially outdoor loop indoors, or portions of the indoor loop outdoors will depend in part on the placement and configuration of the heat exchanger evaporator/condenser, where the two loops come into thermal contact. In an exemplary embodiment where the heat exchanger evaporator/condenser is outdoors, then portions of conduits 205 and/or 235 of the second loop will extend through an exterior building wall to connect with the outdoor heat exchanger evaporator/condenser 140. In an exemplary embodiment where the heat exchanger evaporator/condenser 140 is indoors, then portions of conduits 105 and/or 135 of the first substantially outdoor loop will extend through an exterior building wall to connect with the indoor heat exchanger evaporator/condenser 140. In such an embodiment where portions of the first loop extend indoors, then an enclosure vented to the outside may be provided for the heat exchanger evaporator/condenser 140 and the indoor-extending portions of conduits 105 and/or 135. In another exemplary embodiment, the heat exchanger evaporator/condenser 140 may be integrated with an exterior wall so that neither of the fluid circulation loops will cross outside of their primary (indoor or outdoor) areas.

Figure 2:
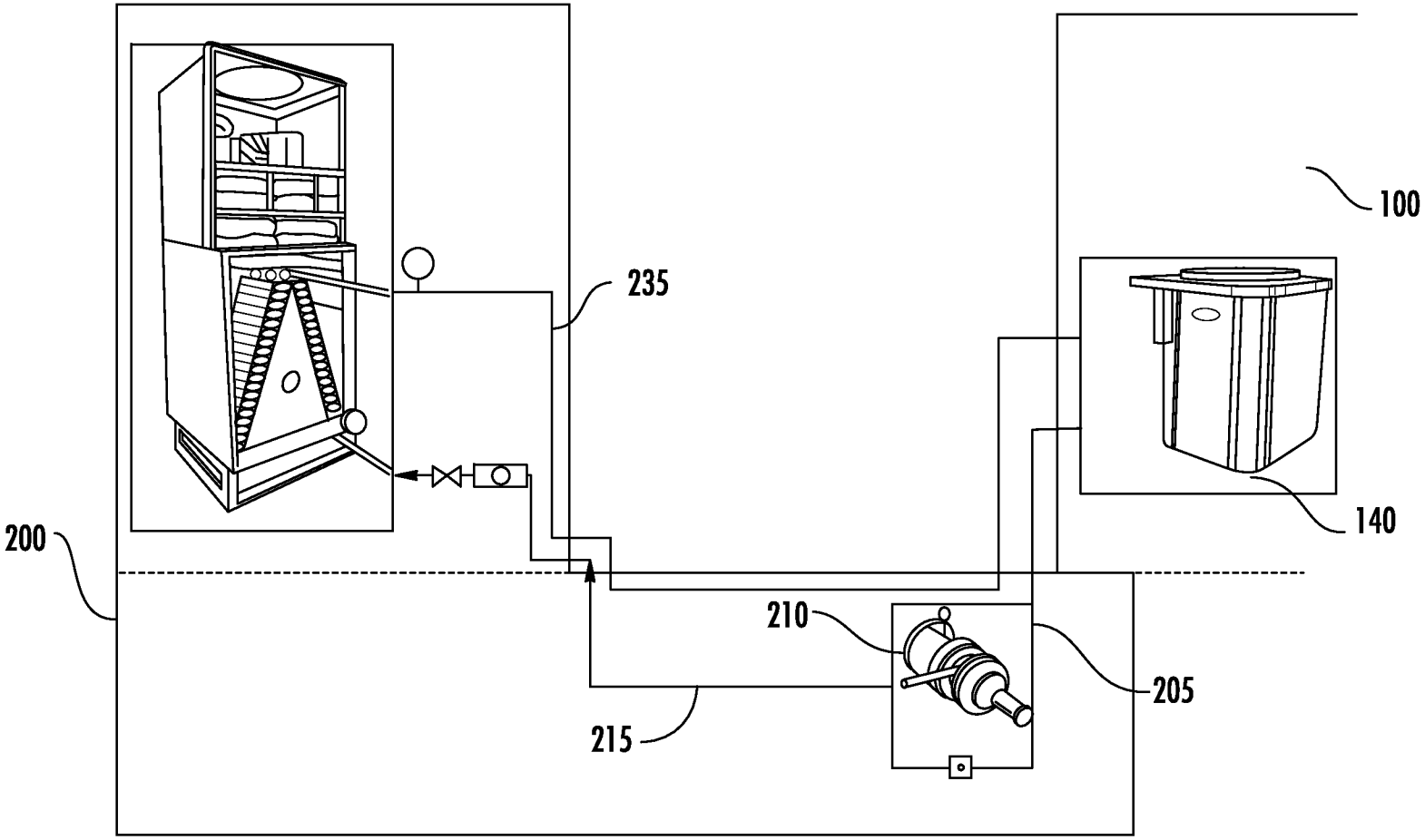
FIG. 2 is an elevation view of an embodiment of a heat transfer system having first and second heat transfer fluid circulation loops.

Referring now to FIG. 2, in some embodiments, the liquid pump 210 is located at a position vertically lower than the heat exchanger evaporator/condenser 140, with conduit 205 extending downwardly from the heat exchanger evaporator/condenser 140 to ensure sufficient column height of the second heat transfer fluid at the inlet of the liquid pump 210 to avoid cavitation of the liquid pump 210. Further, internal volumes of the heat exchanger evaporator/condenser 140 and the heat exchanger evaporator 220 are matched to ensure charge balance of the system during a wide range of expected operating conditions. Still further, in some embodiments, the amount of liquid charge in the system, as a percentage of total heat exchanger volume in the system, is about 50% liquid to ensure proper startup of the system, especially the second fluid circulation loop 200.

Starting operation of the first fluid circulation loop 100 and the second fluid circulation loop 200 requires coordination of various components in the first fluid circulation loop 100 and the second fluid circulation loop 200 via a plurality of actuators controlling components thereof. Initializing operation of the entire loops 100 and 200 simultaneously reduces system efficiency and may result in system stoppage or breakdown. To maximize system efficiency at startup, the first fluid circulation loop 100 is initialized before startup of the second fluid circulation loop 200, typically in a range between 0.1 second and 10 minutes prior to second fluid circulation loop 200 startup. In other embodiments, startup of the second fluid circulation loop 200 is started between 0.1 second and 5 minutes or between 0.1 second and 1 minute after startup of the first fluid circulation loop 100. This ensures a flow of cooled first heat transfer fluid through the heat exchanger evaporator/condenser 140 for thermal exchange with the second heat transfer fluid.

Figure 3:
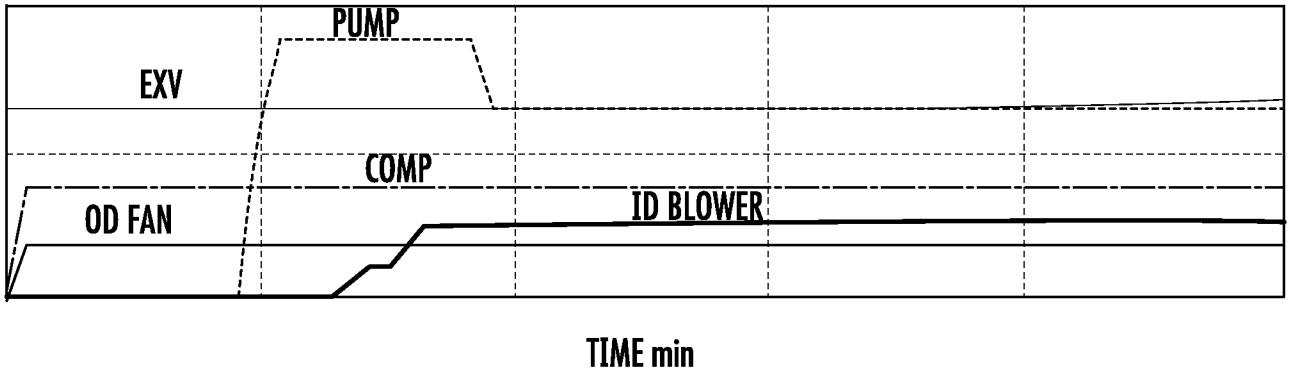
FIG. 3 is a schematic plot illustrating an embodiment of a startup sequence for a heat transfer system having first and second heat transfer fluid circulation loops.

More particularly, as shown in FIG. 3, startup of the system begins with opening of the expansion device 130, followed by startup of the fan 122 to flow air across the condenser 120. The compressor 110 is then started. After compressor 110 startup and flow of the first heat transfer fluid through the heat exchanger evaporator/condenser 140 begins, after a delay of between 0.1 second and 10 minutes, the liquid pump 210 is then started to draw the second heat transfer fluid through the heat exchanger evaporator/condenser 140 and toward the heat exchanger evaporator 220. Once flow of cooled second heat transfer fluid through the heat exchanger evaporator 220 is achieved, fan 225 is started to flow air across the heat exchanger evaporator 220.

Similarly, when stopping operation of the system, operation of the first fluid circulation loop 100 is stopped before operation of the second fluid circulation loop 200 is stopped. The time delay between shutdown of the first fluid circulation loop 100 and shutdown of the second fluid transfer loop 200 is in a range of between 0.1 second and 10 minutes. In other embodiments, the time delay is between 0.1 second and 5 minutes or between 0.1 second and 1 minute.

The heat transfer fluid used in the first fluid circulation loop has a critical temperature of greater than or equal to 31.2° C., more specifically greater than or equal to 35° C., which helps enable it to maintain two phases under normal operating conditions. Exemplary heat transfer fluids for use in the first fluid circulation loop include but are not limited to saturated hydrocarbons (e.g., propane, isobutane), unsaturated hydrocarbons (e.g., propene), R32, R152a, ammonia, an R1234 isomer (e.g., R1234yf, R1234ze, R1234zf), R410a, and mixtures comprising one or more of the foregoing.

The heat transfer fluid used in the second fluid circulation loop has an ASHRAE Class A toxicity rating and an ASHRAE Class 1 or 2L flammability rating. Exemplary heat transfer fluids for use in the second fluid circulation loop include but are not limited to sub-critical fluid $CO_2$, a mixture comprising an R1234 isomer (e.g., R1234yf, R1234ze) and an R134 isomer (e.g., R134a, R134) or R32, 2-phase water, or mixtures comprising one or more of the foregoing. In another exemplary embodiment, the second heat transfer fluid comprises at least 25 wt %, and more specifically at least 50 wt % sub-critical fluid $CO_2$. In yet another exemplary embodiment, the second heat transfer fluid comprises nanoparticles to provide enhanced thermal conductivity. Exemplary nanoparticles include, but are not limited to, particles having a particle size less than 500 nm (more specifically less than 200 nm). In an exemplary embodiment, the nanoparticles have a specific heat greater than that of the second fluid. In yet another exemplary embodiment, the nanoparticles have a thermal conductivity greater than that of the second fluid. In further exemplary embodiments, the nanoparticles have a specific heat greater than at least 5 J/mol·K (more specifically at least 20 J/mol·K), and/or a thermal conductivity of at least 0.5 W/m·K (more specifically at least 1 W/m·K). In another exemplary embodiment, the second heat transfer fluid comprises greater than 0 wt % and less than or equal to 10 wt % nanoparticles, more specifically from 0.01 to 5 wt % nanoparticles. Exemplary nanoparticles include but are not limited to carbon nanotubes and metal or metalloid oxides such as $Si_2O_3$, CuO, or $Al_2O_3$.

The expansion device used in the first heat transfer fluid circulation loop may be any sort of known thermal expansion device, including a simple orifice or a thermal expansion valve (TXV) or an electronically controllable expansion valve (EXV). Expansion valves can be controlled to control superheating at the outlet of the heat absorption side of the heat exchanger evaporator/condenser and optimize system performance. Such devices and their operation are well-known in the art and do not require additional detailed explanation herein.

In another exemplary embodiment, one or more of the compressor 110, fan 122, fan 225, and/or pump 210 utilizes a variable speed drive (VSD). Control of VSD's can be implemented utilizing known power control technologies, such as an integrated power electronic system incorporating an input power factor correction (PFC) rectifier and one or more inverters (e.g., an inverter for each separate VSD). The input PFC rectifier converts single-phase AC input voltage into a regulated DC common bus voltage in order to provide a near unity power factor with low harmonic current from the AC supply. The motor inverters can be connected in parallel with input drawn from the common DC bus. Motors with higher power requirements (e.g., >1 kW such as for compressors) can use insulated gate bipolar transistors (IGBT's) as power switches whereas motors with lower power requirements (e.g., <1 kW such as for fan blowers) can use lower-cost metal oxide semiconductor field effect transistors (MOSFET's). Any type of electric motor can be used in the VSD's, including induction motors or permanent magnet (PM) motors. In an exemplary embodiment, the compressor 110 utilizes a PM motor, optionally in conjunction with electronic circuitry and/or a microprocessor that adaptively estimates the rotor magnet position using only the winding current signals, thus eliminating the need for expensive Hall effect sensors typically used in PM motors. The precise speed settings of the VSD's will vary depending on the demands placed on the system, but can be set by system control algorithms to maximize system operating efficiency and/or meet system demand as is known in the art. Typically, compressor and pump speed can be varied to control system capacity based on user demand, while the speed of the indoor and outdoor fan blowers can be controlled to optimize system efficiency.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A method of operating a heat transfer system comprising:

starting operation of a first heat transfer fluid circulation loop including:

a fluid pumping mechanism;

a condenser for rejecting thermal energy from a first heat transfer fluid;

a condenser fan to urge an airflow across the condenser;

an expansion valve; and an intermediate heat exchanger for absorbing thermal energy into the first heat transfer fluid;

wherein a first conduit in a closed fluid circulation loop circulates the first heat transfer fluid therethrough;

wherein starting operation of the first heat transfer fluid circulation loop includes:

opening of the expansion valve;

starting operation of the condenser fan after opening of the expansion valve; and starting operation of the fluid pumping mechanism after starting operation of the condenser fan; and starting operation of a second two-phase heat transfer fluid circulation loop after starting operation of the first heat transfer fluid circulation loop, the second heat transfer fluid circulation loop in thermal connection with the first heat transfer circulation loop at the intermediate heat exchanger and including:

a liquid pump to urge a second heat transfer fluid through the second heat transfer circulation loop; and an evaporator;

wherein a second conduit in a closed fluid circulation loop circulates the second heat transfer fluid therethrough, and is configured to exchange thermal energy between the first heat transfer fluid and the second heat transfer fluid at the intermediate heat exchanger; and wherein operation of the liquid pump is started after operation of the fluid pumping mechanism.

2. The method of claim 1, wherein the fluid pumping mechanism is a compressor.

3. The method of claim 1, further comprising flowing first heat transfer fluid through the intermediate heat exchanger prior to starting operation of the second two-phase heat transfer fluid circulation loop.

4. The method of claim 3, wherein flowing first heat transfer fluid through the intermediate heat exchanger via the first conduit is driven by startup of the fluid pumping mechanism.

5. The method of claim 1, further comprising starting an evaporator fan after starting the liquid pump.

6. The method of claim 1, wherein a time delay between starting operation of the first heat transfer fluid circulation loop and starting operation of the second heat transfer fluid circulation loop is between 0.1 second and 10 minutes.

7. The method of claim 6, wherein the time delay is between 0.1 second and 5 minutes.

8. The method of claim 7, wherein the time delay is between 0.1 second and 1 minute.

9. The method of claim 1, wherein the first heat transfer fluid circulation loop is disposed entirely outdoors.

10. The method of claim 1, wherein the second heat transfer fluid circulation loop is disposed at least partially indoors.

11. The method of claim 1, wherein the second heat transfer fluid has an ASHRAE Class A toxicity rating and an ASHRAE Class 1 or 2L flammability rating.

12. The method of claim 1, wherein the first heat transfer fluid comprises propane, propene, isobutane, R32, R152a, ammonia, an R1234 isomer, or R410A, or a mixture of any of the above.

13. The method of claim 1, wherein the second heat transfer fluid comprises sub-critical fluid $CO_2$.

14. The method of claim 1, wherein the second heat transfer fluid comprises at least 50% liquid.

* * * * *